US012736312B2

(12) United States Patent
Kern

(10) Patent No.: US 12,736,312 B2
(45) Date of Patent: Sep. 15, 2026

(54) CONDUCTED ELECTRICAL WEAPON CARTRIDGE COVER AND SHORTING BAR

(71) Applicant: Axon Enterprise, Inc., Scottsdale, AZ (US)

(72) Inventor: Lynn Russell Kern, Phoenix, AZ (US)

(73) Assignee: AXON ENTERPRISE, INC., Scottsdale, AZ (US)

( * ) Notice: Subject to any disclaimer, the term of this patent is extended or adjusted under 35 U.S.C. 154(b) by 128 days.

(21) Appl. No.: 18/697,704

(22) PCT Filed: Sep. 30, 2022

(86) PCT No.: PCT/US2022/045447

§ 371 (c)(1),
(2) Date: Apr. 1, 2024

(87) PCT Pub. No.: WO2023/056059

PCT Pub. Date: Apr. 6, 2023

(65) Prior Publication Data

US 2024/0410681 A1 Dec. 12, 2024

Related U.S. Application Data

(60) Provisional application No. 63/251,413, filed on Oct. 1, 2021.

(51) Int. Cl.
*F41H 13/00* (2006.01)
*F41A 17/06* (2006.01)

(52) U.S. Cl.
CPC ..... *F41H 13/0025* (2013.01); *F41A 17/06* (2013.01)

(58) Field of Classification Search
CPC ..... F41A 17/06; F41H 13/0025
(Continued)

(56) References Cited

U.S. PATENT DOCUMENTS 8,096,076 B1 * 1/2012 Cerovic ..... F41A 17/063 361/232
2017/0268842 A1 * 9/2017 Kennair, Jr. ..... F41A 17/063
(Continued)

FOREIGN PATENT DOCUMENTS

CN 205957818 U * 2/2017
TW I326351 B 6/2010
(Continued)

OTHER PUBLICATIONS

Machine translation of Zhang et al. Chinese Patent Document CN 205957818 U Feb. 2017 (Year: 2017).*
(Continued)

*Primary Examiner* — Kevin J Comber
(74) *Attorney, Agent, or Firm* — H S. Malvich, Jr.; Andrew Graham

(57) ABSTRACT

A conducted electrical weapon ("CEW") comprises one or more mechanisms for preventing accidental deployment. A cap may be disposed on a first end of the CEW handle. A shorting mechanism may be configured to connect one or more deployment unit contacts and one or more handle contacts. The cap and the shorting mechanism may be ejected or burned through responsive to a safety switch of the CEW being activated by a user of the CEW, such that the cap and shorting mechanism do not interfere with intentional deployment.

20 Claims, 7 Drawing Sheets

(58) Field of Classification Search
USPC ..... 361/232
See application file for complete search history.

(56) References Cited

U.S. PATENT DOCUMENTS

| | | | | |
|---|---|---|---|---|
| 2019/0257622 | A1 | 8/2019 | Lavin et al. | |
| 2020/0109933 | A1* | 4/2020 | Brundula | F42C 19/12 |
| 2021/0071999 | A1* | 3/2021 | Salisbury | F41H 13/0025 |

FOREIGN PATENT DOCUMENTS

| | | | |
|---|---|---|---|
| TW | I678511 | B | 12/2019 |
| TW | 202113301 | A | 4/2021 |
| WO | 2020136294 | A1 | 7/2020 |

OTHER PUBLICATIONS

European Patent Office, Extended European Search Report for European Application No. 22877407.1, mailed Jul. 15, 2025.
Taiwan Patent Office, Allowance Decision of Examination for Taiwan Application No. 18/697,704 mailed Aug. 5, 2024.
Korean Intellectual Property Office, International Search Report for International Application No. PCT/US22/45447 mailed Jan. 31, 2023.

* cited by examiner

CONDUCTED ELECTRICAL WEAPON CARTRIDGE COVER AND SHORTING BAR

CROSS-REFERENCE TO RELATED APPLICATIONS

This application claims priority to International PCT Application PCT/US22/45447, filed Sep. 30, 2022, which claims the benefit of U.S. Provisional Application 63/251,413, filed Oct. 1, 2021, which is incorporated by reference herein in its entirety.

FIELD OF THE INVENTION

Embodiments of the present invention relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1A:
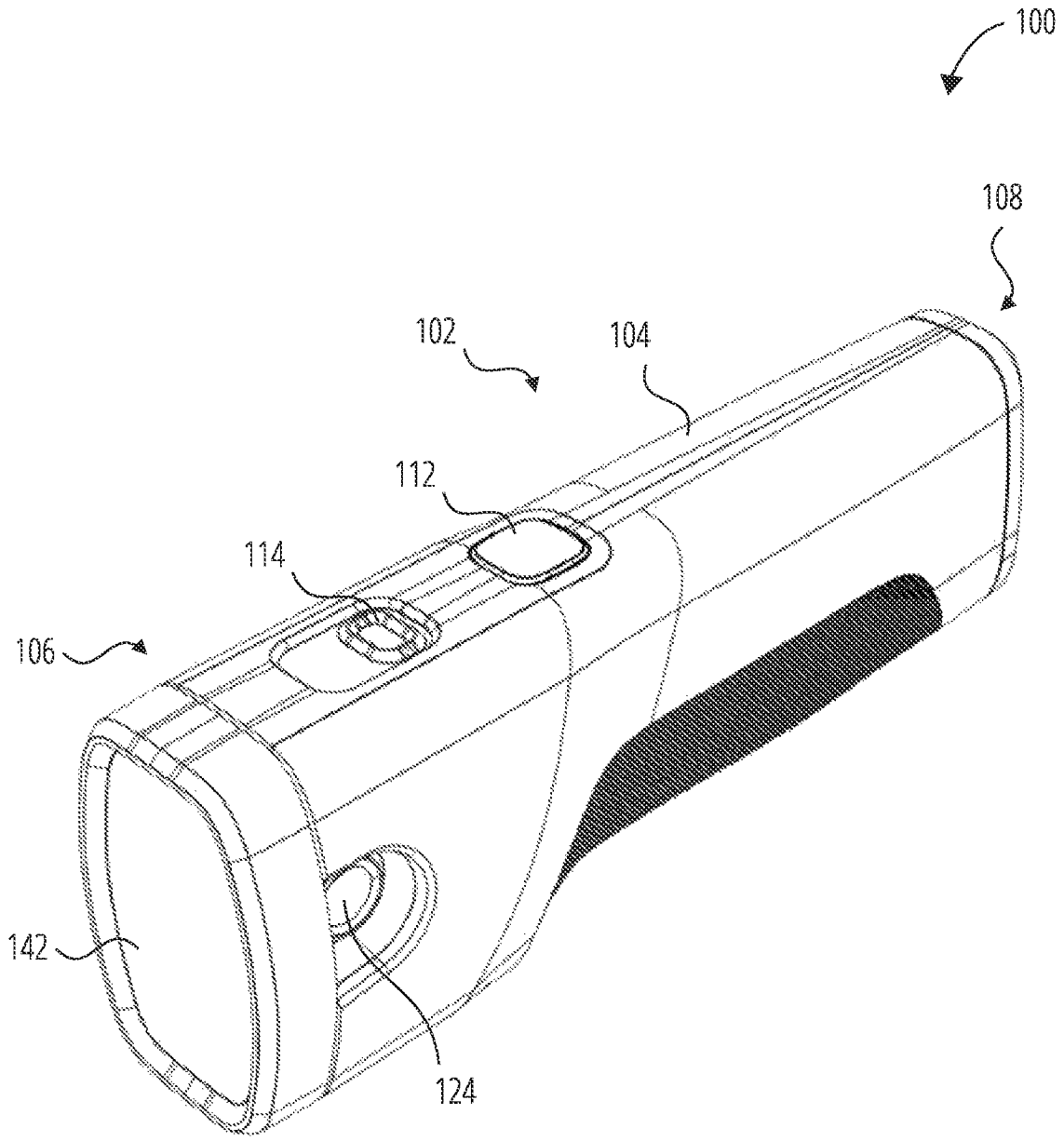
FIG. 1A is a perspective view of a conducted electrical weapon ("CEW"), in accordance with various embodiments.
Figure 1B:
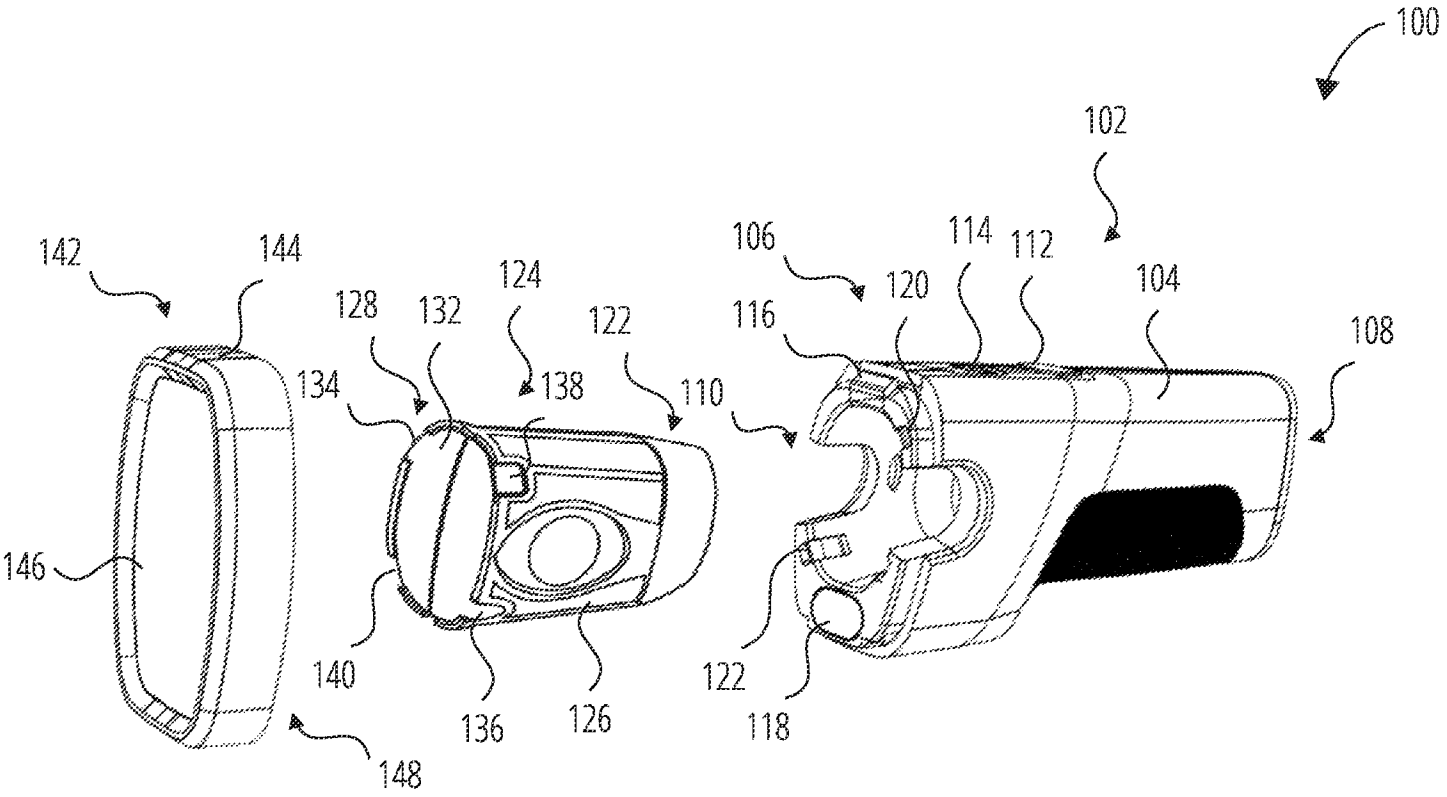
FIG. 1B is an exploded view of the CEW, in accordance with various embodiments.
Figure 1C:
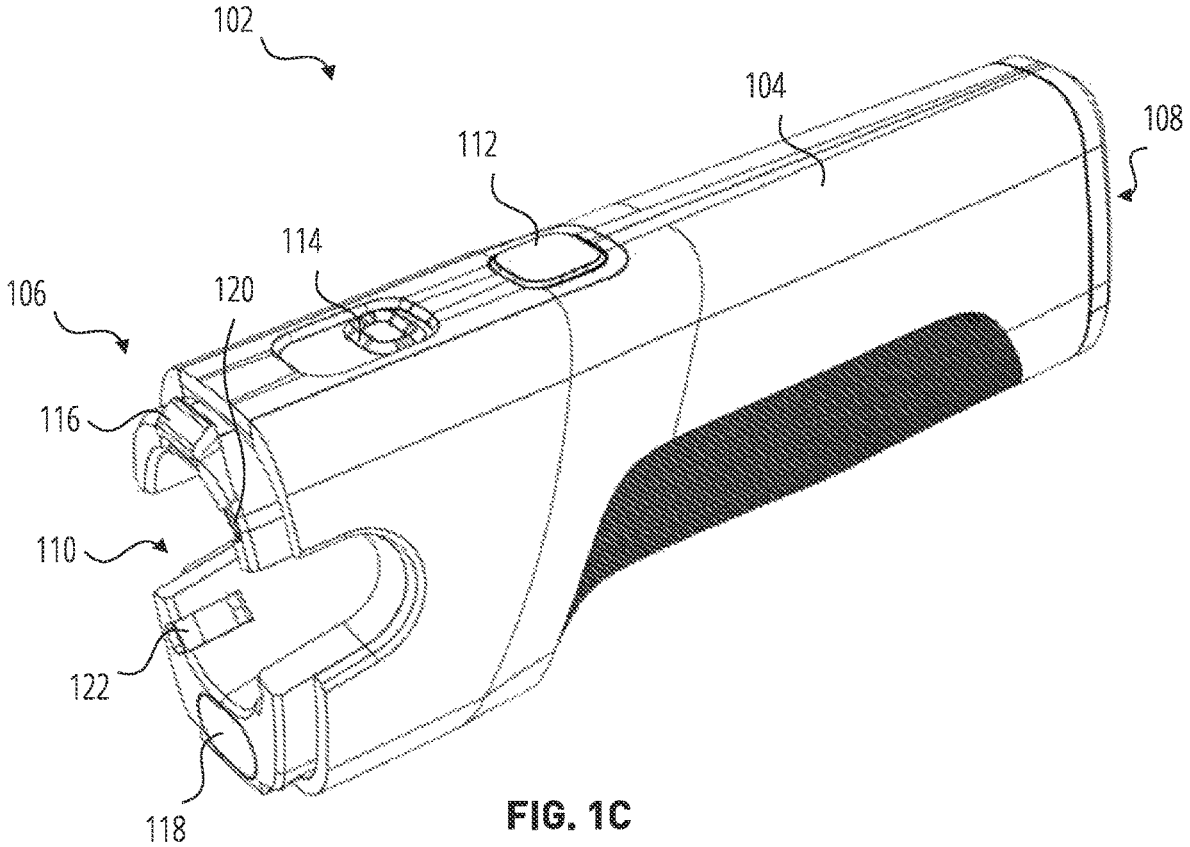
FIG. 1C is a perspective view of a handle of the CEW, in accordance with various embodiments.
Figure 1D:
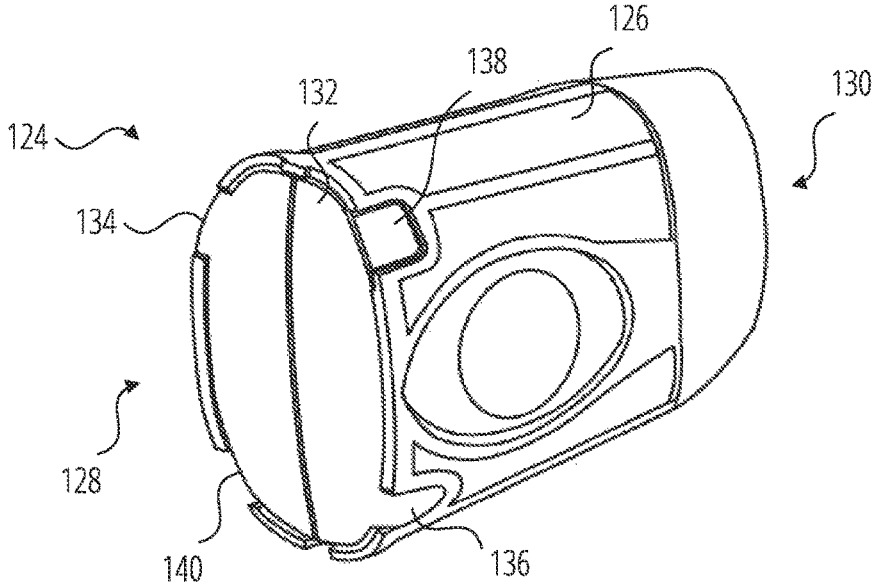
FIG. 1D is a perspective view of a deployment unit of the CEW, in accordance with various embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a deployment unit (e.g., cartridge). The terminals are spaced apart from each other. In response to the electrodes of the deployment unit in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more deployment units. The handle may include one or more bays for receiving the deployment units. Each deployment unit may be removably positioned in (e.g., inserted into, coupled to, etc.) a bay. Each deployment unit may releasably electrically, electronically, and/or mechanically couple to a bay. A deployment of the CEW may launch one or more electrodes toward a target to remotely deliver the stimulus signal through the target.

In various embodiments, a deployment unit may include two or more electrodes that are launched at the same time. In various embodiments, a deployment unit may include two or more electrodes that may be launched individually at separate times. Launching the electrodes may be referred to as activating (e.g., firing) a deployment unit. After use (e.g., activation, firing), a deployment unit may be removed from the bay and replaced with an unused (e.g., not fired, not activated) deployment unit to permit launch of additional electrodes.

In various embodiments, a CEW may comprise a handle and one or more deployment units (e.g., cartridges). A handle may be configured to house various components of the CEW that are configured to enable deployment of deployment units, provide an electrical current to deployment units, and otherwise aid in the operation of the CEW. A handle may comprise a handle end opposite a deployment end. The deployment end may be configured, and sized and shaped, to receive one or more deployment units. The handle end may be sized and shaped to be held in a hand of a user. For example, the handle end may be shaped as a handle to enable hand-operation of the CEW by a user. In various embodiments, the handle end may also comprise contours shaped to fit the hand of a user, for example, an ergonomic grip. The handle end may include a surface coating, such as, for example, a non-slip surface, a grip pad, a rubber texture, and/or the like. As a further example, the handle end may be wrapped in leather, a colored print, and/or any other suitable material, as desired.

In various embodiments, a handle may comprise various mechanical, electronic, and/or electrical components configured to aid in performing the functions of the CEW. For example, a handle may comprise one or more triggers, control interfaces, processing circuits, power supplies, and/or signal generators. A handle may include a trigger guard. The trigger guard may define an opening formed in the handle. The trigger guard may be located on a center region of the handle, and/or in any other suitable location on the handle. The trigger may be disposed within the trigger guard. The trigger guard may be configured to protect the trigger from unintentional physical contact (e.g., an unintentional activation of the trigger). The trigger guard may surround the trigger within the handle.

In various embodiments, a trigger be coupled to an outer surface of the handle, and may be configured to move, slide, rotate, or otherwise become physically depressed or moved upon application of physical contact. For example, a trigger may be actuated by physical contact applied to the trigger from within a trigger guard. A trigger may comprise a mechanical or electromechanical switch, button, trigger, or the like. For example, the trigger may comprise a switch, a pushbutton, and/or any other suitable type of trigger. The trigger may be mechanically and/or electronically coupled to a processing circuit. In response to the trigger being activated (e.g., depressed, pushed, etc. by the user), the processing circuit may enable deployment of one or more deployment units from the CEW, as discussed further herein.

In various embodiments, a power supply may be configured to provide power to various components of the CEW. For example, the power supply may provide energy for operating the electronic and/or electrical components (e.g., parts, subsystems, circuits, etc.) of the CEW and/or one or more deployment units. The power supply may provide electrical power. Providing electrical power may include providing a current at a voltage. The power supply may be electrically coupled to a processing circuit and/or a signal generator. In various embodiments, in response to a control interface comprising electronic properties and/or components, the power supply may be electrically coupled to the control interface. In various embodiments, in response to a trigger comprising electronic properties or components, the power supply may be electrically coupled to the trigger. The power supply may provide an electrical current at a voltage. Electrical power from the power supply may be provided as a direct current ("DC"). Electrical power from the power supply may be provided as an alternating current ("AC"). The power supply may include a battery. The energy of the power supply may be renewable or exhaustible, and/or replaceable. For example, the power supply may comprise one or more rechargeable or disposable batteries. In various embodiments, the energy from the power supply may be converted from one form (e.g., electrical, magnetic, thermal) to another form to perform the functions of a system.

A power supply may provide energy for performing the functions of the CEW. For example, the power supply may provide the electrical current to a signal generator that is provided through a target to impede locomotion of the target (e.g., via a deployment unit). The power supply may provide the energy for a stimulus signal. The power supply may provide the energy for other signals, including an ignition signal and/or an integration signal, as discussed further herein.

In various embodiments, a processing circuit may comprise any circuitry, electrical components, electronic components, software, and/or the like configured to perform various operations and functions discussed herein. For example, a processing circuit may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, a processing circuit may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, a processing circuit may include data buses, output ports, input ports, timers, memory, arithmetic units, and/or the like.

A processing circuit may be configured to provide and/or receive electrical signals whether digital and/or analog in form. A processing circuit may provide and/or receive digital information via a data bus using any protocol. A processing circuit may receive information, manipulate the received information, and provide the manipulated information. A processing circuit may store information and retrieve stored information. Information received, stored, and/or manipulated by a processing circuit may be used to perform a function, control a function, and/or to perform an operation or execute a stored program.

A processing circuit may control the operation and/or function of other circuits and/or components of the CEW. A processing circuit may receive status information regarding the operation of other components, perform calculations with respect to the status information, and provide commands (e.g., instructions) to one or more other components. A processing circuit may command another component to start operation, continue operation, alter operation, suspend operation, cease operation, or the like. Commands and/or status may be communicated between a processing circuit and other circuits and/or components via any type of bus (e.g., SPI bus) including any type of data/address bus.

In various embodiments, a processing circuit may be mechanically and/or electronically coupled to a trigger. The processing circuit may be configured to detect an activation, actuation, depression, input, etc. (collectively, an "activation event") of the trigger. In response to detecting the activation event, the processing circuit may be configured to perform various operations and/or functions, as discussed further herein. The processing circuit may also include a sensor (e.g., a trigger sensor) attached to the trigger and configured to detect an activation event of the trigger. The sensor may comprise any suitable sensor, such as a mechanical and/or electronic sensor capable of detecting an activation event in the trigger and reporting the activation event to the processing circuit.

In various embodiments, a processing circuit may be mechanically and/or electronically coupled to a control interface. The processing circuit may be configured to detect an activation, actuation, depression, input, etc. (collectively, a "control event") of the control interface. In response to detecting the control event, the processing circuit may be configured to perform various operations and/or functions, as discussed further herein. The processing circuit may also include a sensor (e.g., a control sensor) attached to the control interface and configured to detect a control event of the control interface. The sensor may comprise any suitable mechanical and/or electronic sensor capable of detecting a control event in the control interface and reporting the control event to the processing circuit.

In various embodiments, a processing circuit may be electrically and/or electronically coupled to a power supply. The processing circuit may receive power from the power supply. The power received from the power supply may be used by the processing circuit to receive signals, process signals, and transmit signals to various other components in the CEW. The processing circuit may use power from the power supply to detect an activation event of a trigger, a control event of a control interface, or the like, and generate one or more control signals in response to the detected events. The control signal may be based on the control event and the activation event. The control signal may be an electrical signal.

In various embodiments, a processing circuit may be electrically and/or electronically coupled to a signal generator. The processing circuit may be configured to transmit or provide control signals to the signal generator in response to detecting an activation event of a trigger. Multiple control signals may be provided from the processing circuit to the signal generator in series. In response to receiving the control signal, the signal generator may be configured to perform various functions and/or operations, as discussed further herein.

In various embodiments, a CEW may comprise a communications circuit. The communications circuit may comprise standalone components and/or modules or may be at least partially integrated within the processing circuit. The communications circuit may be similar to, or comprise similar components with, any other communication unit, short-range communication unit, long-range communication unit, or the like disclosed here. The communications circuit may enable electronic communications between devices and systems. The communications circuit may enable communications over a network. For example, the communications circuit may include a modem, a network interface (such as an Ethernet card), a communications port, or the like. Data may be transferred via the communications circuit in the form of signals which may be electronic, electromagnetic, optical, or other signals capable of being transmitted or received by a communications unit. The communications circuit may be configured to communicate via any wired protocol, wireless protocol, or other protocol capable of transmitting information via a wired or wireless connection. In various embodiments, the communications circuit may be configured to enable short-range communications between devices. In various embodiments, the communications circuit may be configured to enable long-range communications between devices or systems. In various embodiments, the communications circuit may be configured to enable both short-range communications and long-range communications.

In various embodiments, a "communications circuit" as described herein may comprise any suitable hardware and/or software components capable of enabling the transmission and/or reception of data. A communications circuit may enable electronic communications between devices and systems. A communications circuit may enable communications over a network. Examples of a communications circuit may include a modem, a network interface (such as an Ethernet card), a communications port, etc. Data may be transferred via a communications circuit in the form of signals which may be electronic, electromagnetic, optical, or other signals capable of being transmitted or received by a communications circuit. A communications circuit may be configured to communicate via any wired or wireless protocol such as a CAN bus protocol, an Ethernet physical layer protocol (e.g., those using 10BASE-T, 100BASE-T, 1000BASE-T, etc.), an IEEE 1394 interface (e.g., FireWire), Integrated Services for Digital Network (ISDN), a digital subscriber line (DSL), an 802.11a/b/g/n/ac signal (e.g., Wi-Fi), a wireless communications protocol using short wavelength UHF radio waves and defined at least in part by IEEE 802.15.1 (e.g., the BLUETOOTH® protocol maintained by Bluetooth Special Interest Group), a wireless communications protocol defined at least in part by IEEE 802.15.4 (e.g., the ZigBee® protocol maintained by the ZigBee alliance), a cellular protocol, an infrared protocol, an optical protocol, or any other protocol capable of transmitting information via a wired or wireless connection.

In various embodiments, a signal generator may be configured to receive one or more control signals from a processing circuit. The signal generator may provide an ignition signal to one or more deployment units based on the control signals. The signal generator may be electrically and/or electronically coupled to a processing circuit and/or one or more deployment units. The signal generator may be electrically coupled to a power supply. The signal generator may use power received from the power supply to generate an ignition signal. For example, the signal generator may receive an electrical signal from the power supply that has first current and voltage values. The signal generator may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. The signal generator may temporarily store power from the power supply and rely on the stored power entirely or in part to provide the ignition signal. The signal generator may also rely on received power from the power supply entirely or in part to provide the ignition signal, without needing to temporarily store power.

A signal generator may be controlled entirely or in part by a processing circuit. In various embodiments, a signal generator and a processing circuit may be separate components (e.g., physically distinct and/or logically discrete). A signal generator and a processing circuit may be a single component. For example, a control circuit within the handle may at least include a signal generator and a processing circuit. The control circuit may also include other components and/or arrangements, including those that further integrate corresponding function of these elements into a single component or circuit, as well as those that further separate certain functions into separate components or circuits.

A signal generator may be controlled by the control signals to generate an ignition signal having a predetermined current value or values. For example, the signal generator may include a current source. The control signal may be received by the signal generator to activate the current source at a current value of the current source. An additional control signal may be received to decrease a current of the current source. For example, the signal generator may include a pulse width modification circuit coupled between a current source and an output of the control circuit. A second control signal may be received by the signal generator to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators may alternatively or additionally be employed, including those that apply a voltage over one or more different resistances to generate signals with different currents. In various embodiments, a signal generator may include a high-voltage module configured to deliver an electrical current having a high voltage. In various embodiments, a signal generator may include a low-voltage module configured to deliver an electrical current having a lower voltage, such as, for example, 2,000 volts.

Responsive to receipt of a signal indicating activation of a trigger (e.g., an activation event), a control circuit provides an ignition signal to one or more deployment units. For example, a signal generator may provide an electrical signal as an ignition signal to a deployment unit in response to receiving a control signal from a processing circuit. In various embodiments, the ignition signal may be separate and distinct from a stimulus signal. For example, a stimulus signal in a CEW may be provided to a different circuit within a deployment unit, relative to a circuit to which an ignition signal is provided. The signal generator may be configured to generate a stimulus signal. In various embodiments, a second, separate signal generator, component, or circuit (not shown) within the handle may be configured to generate the stimulus signal. The signal generator may also provide a ground signal path for a deployment unit, thereby completing a circuit for an electrical signal provided to the deployment unit by the signal generator. The ground signal path may also be provided to the deployment unit by other elements in the handle, including a power supply.

In various embodiments, a deployment unit may comprise a propulsion system and a plurality of projectiles, such as, for example, a first projectile and a second projectile. A deployment unit may comprise any suitable or desired number of projectiles, such as, for example two projectiles, three projectiles, nine projectiles, twelve projectiles, eighteen projectiles, and/or any other desired number of projectiles. Further, a handle may be configured to receive any suitable or desired number of deployment units, such as, for example, one deployment unit, two deployment units, three deployment units, etc.

In various embodiments, a propulsion system may be coupled to, or in communication with, each projectile in a deployment unit. In various embodiments, a deployment unit may comprise a plurality of propulsion systems, with each propulsion system coupled to, or in communication with, one or more projectiles. A propulsion system may comprise any device, propellant (e.g., air, gas, etc.), primer, or the like capable of providing a propulsion force in a deployment unit. The propulsion force may include an increase in pressure caused by rapidly expanding gas within an area or chamber. The propulsion force may be applied to projectiles in a deployment unit to cause the deployment of the projectiles. A propulsion system may provide the propulsion force in response to a deployment unit receiving the ignition signal.

In various embodiments, the propulsion force may be directly applied to one or more projectiles. For example, the propulsion force may be provided directly to a first projectile and/or a second projectile. A propulsion system may be in fluid communication with the projectiles to provide the propulsion force. For example, the propulsion force from the propulsion system may travel within a housing or channel of the deployment unit to one or more projectiles. The propulsion force may travel via a manifold in the deployment unit.

In various embodiments, the propulsion force may be provided indirectly to a first projectile and/or a second projectile. For example, the propulsion force may be provided to a secondary source of propellant within the propulsion system. The propulsion force may launch the secondary source of propellant within the propulsion system, causing the secondary source of propellant to release propellant. A force associated with the released propellant may in turn provide a force to the first projectile and/or the second projectile. A force generated by a secondary source of propellant may cause the first projectile and/or the second projectile to be deployed from the deployment unit and the CEW.

In various embodiments, a projectile may comprise any suitable type of projectile. For example, one or more projectiles may be or include an electrode (e.g., an electrode dart). An electrode may include a spear portion configured to pierce or attach proximate a tissue of a target in order to provide a conductive electrical path between the electrode and the tissue, as previously discussed herein. For example, projectiles may each include a respective electrode. Projectiles may be deployed from a deployment unit at the same time or substantially the same time. Projectiles may be launched by a same propulsion force from a common propulsion system. Projectiles may also be launched by one or more propulsion forces received from one or more propulsion systems. A deployment unit may include an internal manifold configured to transfer a propulsion force from a propulsion system to one or more projectiles. As a further example, one or more projectiles disclosed herein may be or include an electrode (e.g., an electrode dart), an entangling projectile (e.g., a tether-based entangling projectile, a net, etc.), a payload projectile (e.g., comprising a liquid or gas substance), or the like.

A control interface may comprise, or be similar to, any control interface disclosed herein. In various embodiments, a control interface may be configured to control selection of firing modes in a CEW. Controlling selection of firing modes may include disabling firing of a CEW (e.g., a safety mode, etc.), enabling firing of the CEW (e.g., an active mode, a firing mode, an escalation mode, etc.), controlling deployment of deployment units, and/or similar operations, as discussed further herein.

A control interface may be located in any suitable location on or in a handle. For example, a control interface may be coupled to an outer surface of a handle. A control interface may be coupled to an outer surface of a handle proximate a trigger and/or a trigger guard. A control interface may be electrically, mechanically, and/or electronically coupled to a processing circuit. In various embodiments, in response to a control interface comprising electronic properties or components, the control interface may be electrically coupled to a power supply. The control interface may receive power (e.g., electrical current) from the power supply to power the electronic properties or components.

A control interface may be electronically or mechanically coupled to a trigger. For example, and as discussed further herein, a control interface may function as a safety mechanism. In response to the control interface being set to a "safety mode," a CEW may be unable to launch projectiles from a deployment unit. For example, the control interface may provide a signal (e.g., a control signal) to a processing circuit instructing the processing circuit to disable deployment of deployment units. As a further example, a control interface may electronically or mechanically prohibit a trigger from activating (e.g., prevent or disable a user from depressing the trigger; prevent the trigger from launching a projectile; etc.).

A control interface may comprise any suitable electronic or mechanical component capable of enabling selection of firing modes. For example, a control interface may comprise a fire mode selector switch, a safety switch, a safety catch, a rotating switch, a selection switch, a selective firing mechanism, and/or any other suitable mechanical control.

As a further example, a control interface may comprise a slide, such as a handgun slide, a reciprocating slide, or the like. As a further example, a control interface may comprise a touch screen or similar electronic component.

The safety mode may be configured to prohibit deployment of an electrode or other projectile from a deployment unit. For example, in response to a user selecting the safety mode, the control interface may transmit a safety mode instruction to a processing circuit. In response to receiving the safety mode instruction, the processing circuit may prohibit deployment of a projectile from a deployment unit. The processing circuit may prohibit deployment until a further instruction is received from the control interface (e.g., a firing mode instruction). As previously discussed, a control interface may also, or alternatively, interact with a trigger to prevent activation of the trigger. In various embodiments, the safety mode may also be configured to prohibit provision of a stimulus signal from signal generator, such as, for example, during a local delivery.

The firing mode may be configured to enable deployment of one or more projectiles from a deployment unit. For example, and in accordance with various embodiments, in response to a user selecting the firing mode, the control interface may transmit a firing mode instruction to the processing circuit. In response to receiving the firing mode instruction, the processing circuit may enable deployment of a projectile from the deployment unit. In that regard, in response to the trigger being activated, the processing circuit may cause the deployment of one or more projectiles. The processing circuit may enable deployment until a further instruction is received from the control interface (e.g., a safety mode instruction). As a further example, and in accordance with various embodiments, in response to a user selecting the firing mode, the control interface may also mechanically (or electronically) interact with the trigger to enable activation of the trigger.

In various embodiments, and with reference to FIGS. 1A-1D, a CEW 100 is disclosed. CEW 100 may be similar to, or have similar aspects and/or components with, any CEW discussed herein. CEW 100 may comprise a handle 102, a deployment unit 124, and/or a cap 142.

In various embodiments, handle 102 may be similar to, or have similar aspects and/or components with, any CEW handle, housing, or the like discussed herein. Handle 102 may be configured to house various components of CEW 100 that are configured to enable deployment of electrodes from deployment unit 124, provide an electrical current to deployment unit 124, and otherwise aid in the operation of CEW 100, as discussed further herein. Handle 102 may comprise any suitable shape and/or size. Handle 102 may comprise a handle body 104 having a first handle end 106 (e.g., a grip end, a handle end, etc.) opposite a second handle end 108 (e.g., a deployment end). Second handle end 108 may be configured, and sized and shaped, to receive one or more deployment units 124. For example, second handle end 108 may define a handle bay 110. Handle bay 110 may be sized and shaped to receive a deployment unit 124. Handle body 104 at second handle end 108 may be sized and shaped to be held in a hand of a user. For example, handle body 104 at second handle end 108 may be shaped as a handle to enable hand-operation of CEW 100 by the user. In various embodiments, handle body 104 at second handle end 108 may also comprise contours shaped to fit the hand of a user, for example, an ergonomic grip. Handle body 104 at second handle end 108 end may include a surface coating, such as, for example, a non-slip surface, a grip pad, a rubber texture, and/or the like. As a further example, a handle body 104 at second handle end 108 may be wrapped in leather, a colored print, and/or any other suitable material, as desired.

In various embodiments, handle 102 may comprise and house various mechanical, electronic, and/or electrical components configured to aid in performing the functions of CEW 100. For example, handle 102 may comprise one or more triggers, control interfaces, processing circuits, memories, communications circuits, power supplies, and/or signal generators. Each processing circuit, memory, communications circuit, power supply, and/or signal generator may be similar to and perform operations similar to any other respective processing circuit, memory, communications circuit, power supply, and/or signal generator disclosed herein.

In various embodiments, trigger 112 may be coupled to an outer surface of handle 102, and may be configured to move, slide, rotate, or otherwise become physically depressed or moved upon application of physical contact. For example, trigger 112 may be actuated by physical contact applied to trigger 112. Trigger 112 may comprise a mechanical or electromechanical switch, button, trigger, or the like. For example, trigger 112 may comprise a switch, a pushbutton, and/or any other suitable type of trigger. Trigger 112 may be mechanically and/or electronically coupled to a processing circuit. In response to trigger 112 being activated (e.g., depressed, pushed, etc. by the user), the processing circuit may enable deployment of (or cause deployment of) one or more electrodes from deployment unit 124, as discussed further herein.

In various embodiments, safety switch 114 may be coupled to an outer surface of handle 102, and may be configured to move, slide, rotate, or otherwise become physically depressed or moved upon application of physical contact. For example, safety switch 114 may be translated from a first position (e.g., a rearward position) to a second position (e.g., a forward position). In that respect, safety switch 114 may comprise a mechanical or electromechanical switch. Safety switch 114 may be mechanically and/or electronically coupled to a processing circuit. In response to safety switch 114 being translated between the first position and the second position, the processing circuit may receive or determine a signal.

Safety switch 114 may comprise, or be similar to, any control interface, safety switch, and/or the like disclosed herein. In various embodiments, safety switch 114 may be configured to control selection of firing modes in CEW 100. Controlling selection of firing modes in CEW 100 may include disabling firing of CEW 100 (e.g., a safety mode, etc.), enabling firing of CEW 100 (e.g., an active mode, a firing mode, an escalation mode, etc.), controlling deployment of deployment unit 124, and/or similar operations, as discussed further herein. In various embodiments, safety switch 114 may also be configured to perform (or cause performance of) one or more operations that do not include the selection of firing modes. For example, safety switch 114 may be configured to enable the selection of operating modes of CEW 100, selection of options within an operating mode of CEW 100, or similar selection or scrolling operations, as discussed further herein.

Safety switch 114 may be electronically or mechanically coupled to trigger 112. For example, and as discussed further herein, safety switch 114 may function as a safety mechanism. In response to safety switch 114 being set to a "safety mode," CEW 100 may be unable to launch electrodes from deployment unit 124. For example, safety switch 114 may provide a signal (e.g., a control signal) to a processing circuit instructing the processing circuit to disable deployment of electrodes from deployment unit 124. As a further example, safety switch 114 may electronically or mechanically prohibit trigger 112 from activating (e.g., prevent or disable a user from depressing trigger 112; prevent trigger 112 from launching an electrode; etc.).

In various embodiments, safety switch 114 may be mechanically coupled to handle mechanical coupling interface 116. Handle mechanical coupling interface 116 may comprise a latch, a protrusion, ejection spring, and/or any other similar mechanical interface. Handle mechanical coupling interface 116 may be disposed on first handle end 106 proximate handle bay 110. Handle mechanical coupling interface 116 may be disposed on a top surface of first handle end 106. Handle mechanical coupling interface 116 may be disposed on a same surface as safety switch 114. Handle mechanical coupling interface 116 may be configured to couple to cap 142, as discussed further herein. Safety switch 114 may be configured to operate handle mechanical coupling interface 116 to allow handle mechanical coupling interface 116 to decouple from cap 142. For example, in response to safety switch 114 being operated into the second position (e.g., the forward position) safety switch 114 may mechanically translate handle mechanical coupling interface 116 causing a coupled cap 142 to decouple and eject (e.g., in a direction away) from first handle end 106.

In various embodiments, CEW 100 may comprise one or more components configured to receive an input from a user. For example, CEW 100 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, CEW 100 may comprise one or more components configured to transmit or produce an output. For example, CEW 100 may comprise an output module 118. Output module 118 may be disposed on first handle end 106, or at any other location on handle body 104. In some embodiments, output module 118 may be at least partially enclosed and/or obstructed in response to cap 142 being coupled to handle 102. Output module 118 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

In some embodiments, output module 118 may be activated and deactivated based on operation of safety switch 114. For example, in response to safety switch 114 being operated into the second position (e.g., the forward position), output module 118 may activate and provide an output. In response to safety switch 114 being operated into the first position (e.g., the rearward position), output module 118 may deactivate and no longer provide the output. In some embodiments, output module 118 may be activated responsive to an operation of trigger 112. In that regard, output module 118 may provide an output during operation of trigger 112, during a period of time after operation of trigger 112 (e.g., 5 seconds), and/or the like.

In various embodiments, deployment unit 124 may be similar to any other deployment unit disclosed herein. Deployment unit 124 may comprise a deployment unit body 126 having a first deployment unit end 128 opposite a second deployment unit end 130. First deployment unit 124 may define an opening configured to store one or more electrodes for deployment.

Deployment unit 124 may comprise one or more propulsion modules and one or more electrodes for deployment. For example, deployment unit 124 may comprise a single propulsion module configured to deploy a single electrode. As a further example, deployment unit 124 may comprise a single propulsion module configured to deploy a plurality of electrodes. As a further example, deployment unit 124 may comprise a plurality of propulsion modules and a plurality of electrodes, with each propulsion module configured to deploy one or more electrodes. In various embodiments, a propulsion module may be coupled to, or in communication with one or more electrodes in deployment unit 124. A propulsion module may comprise any device, propellant (e.g., air, gas, etc.), primer, or the like capable of providing a propulsion force in deployment unit 124. The propulsion force may include an increase in pressure caused by rapidly expanding gas within an area or chamber. The propulsion force may be applied to one or more electrodes in deployment unit 124 to cause the deployment of the one or more electrodes. A propulsion module may provide the propulsion force in response to deployment unit 124 receiving an ignition signal, as previously discussed.

In various embodiments, each electrode in deployment unit 124 may each comprise any suitable type of projectile. For example, one or more electrodes may be or include a projectile, an electrode (e.g., an electrode dart), an entangling projectile, a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

In various embodiments, deployment unit 124 may comprise blast doors 132 coupled to first deployment unit end 128. Blast doors 132 may be configured to obstruct (e.g., cover) the opening and electrodes of deployment unit 124 prior to deployment of the electrodes. Blast doors 132 may be coupled to first deployment unit end 128 at a first coupling point 134 and a second coupling point 136. In response to a deployment of electrodes, blast doors 132 may be configured to open, break, decouple, and/or the like to enable the electrodes to deploy from deployment unit 124. For example, in some embodiments blast doors 132 may comprise a frangible portion configured to break responsive to a deployment.

In various embodiments, handle 102 and deployment unit 124 may be electrically coupled via one or more electrical contacts. For example, handle 102 may comprise a first handle contact 120 and a second handle contact 122. Deployment unit 124 may comprise a first deployment unit contact 138 and a second deployment unit contact 140. First handle contact 120 and second handle contact 122 may be disposed on first handle end 106. For example, first handle contact 120 and second handle contact 122 may be disposed at least partially on a forward surface of first handle end 106 and/or at least partially within handle bay 110. First handle contact 120 and second handle contact 122 may be oriented diagonally from each other, and/or at any other suitable disposition. First handle contact 120 and second handle contact 122 may be electrically coupled to a power supply, a signal generator, and/or the like within handle body 104. In various embodiments, one of first handle contact 120 and second handle contact 122 may be configured to provide a positive voltage and the other of first handle contact 120 and second handle contact 122 may be configured to provide a negative voltage, or ground reference.

First deployment unit contact 138 and second deployment unit contact 140 may be disposed on first deployment unit end 128. For example, first deployment unit contact 138 and second deployment unit contact 140 may be disposed proximate blast doors 132. First deployment unit contact 138 and second deployment unit contact 140 may be disposed at least partially on a forward surface of first deployment unit 124 and/or at least partially on a radially outer surface of deployment unit body 126. First deployment unit contact 138 and second deployment unit contact 140 may be oriented diagonally from each other, and/or at any other suitable disposition. First deployment unit contact 138 and second deployment unit contact 140 may be electrically coupled to a propulsion module, one or more electrodes, and/or one or more filaments of electrodes within deployment unit 124.

In response to deployment unit 124 being inserted within handle bay 110, first handle contact 120 may align with and electrically couple to first deployment unit contact 138, and second handle contact 122 may align with and electrically couple to second deployment unit contact 140. In that regard, a processing circuit, a signal generator, and/or a power supply of handle 102 may provide an electrical signal (e.g., an ignition signal, a stimulus signal, etc.) to deployment unit 124 via the respective handle contacts 120, 122 and the respective deployment unit contacts 138, 140.

In various embodiments, cap 142 may be configured to couple to first handle end 106. Cap 142 may comprise a cap body 144 having an outer cap surface 146 opposite an inner cap surface 148. In response to being coupled to first handle end 106, cap 142 may at least partially obstruct (e.g., cover, seal, etc.) handle bay 110 and/or one or more deployment units 124 disposed within handle bay 110. Inner cap surface 148 may be enclosed between a remaining body of cap 142 and handle 102 when cap 142 is coupled to first handle end 106. Inner cap surface 148 may be oriented toward handle bay 110 when cap 142 is coupled to first handle end 106. Inner cap surface 148 may be proximate blast doors 132 when cap 142 is coupled to first handle end 106 and one or more deployment units 124 disposed within handle bay 110. Outer cap surface 146 may be oriented away from handle 102 when cap 142 is coupled to first handle end 106. In some embodiments, cap may be removably coupled to handle mechanical coupling interface 116. In response to safety switch 114 of handle 102 being activated or translated to a second position, cap 142 may decouple from handle 102. In some embodiments, cap 142 may mechanically decouple from handle mechanical coupling interface 116, such as, for example via an ejection spring or similar mechanical ejection mechanism. In other embodiments, handle 102 may comprise an actuator, electromechanical servo valve, and/or the like. In response safety switch 114 of handle 102 being activated or translated to a second position, a processing circuit of handle 102 may cause the actuator, electromechanical servo valve, and/or the like to decouple and eject cap 142.

In embodiments, blast doors 132 may be physically separate from cap 142. For example, blast doors 132 may be integrated with deployment unit 124, while cap 142 may be removably coupled to handle 102 at first handle end 106. In embodiments, blast doors 132 may provide a lower mechanical resistance to deployment of electrodes relative to a higher mechanical resistance provided by cap 142. Blast doors 132 may comprise a frangible portion, while cap 142 may be non-frangible. Cap 142 may be selectively decoupled from first handle end 106 independent of whether electrodes are deployed from deployment unit, while blast doors 132 may detach from deployment unit 124 upon deployment of the electrodes.

In various embodiments, first handle end 106 may comprise a lip (e.g., a radially inward valley, a surface radially inward from an outermost radial surface, etc.) at least partially encircling handle bay 110. Lip may be sized and shaped such that a radially outer surface of cap 142 may align with a radially outer surface of handle body 104 in response to cap 142 being coupled to first handle end 106.

In various embodiments, as discussed further herein, inner cap surface 148 of cap 142 may be configured to contact first handle end 106 and/or deployment unit 124. For example, inner cap surface 148 may be configured to contact first handle contact 120, second handle contact 122, first deployment unit contact 138, and/or second deployment unit contact 140. In some embodiments, inner cap surface 148 may comprise a shorting mechanism configured to electrically couple in parallel with deployment unit 124. The shorting mechanism may be electrically coupled to first handle contact 120 and second handle contact 122. The shorting mechanism may be electrically coupled to first deployment unit contact 138 and second deployment unit contact 140. The shorting mechanism may be coupled to at least one of first handle contact 120 or first deployment unit contact 138 and at least one of second handle contact 122 or second deployment unit contact 140. In some embodiments, the shorting mechanism is coupled directly to deployment unit 124 via separate contacts (not shown) or coupled to deployment unit 124 via first handle contact 120 and second handle contact 122.

Figure 2:
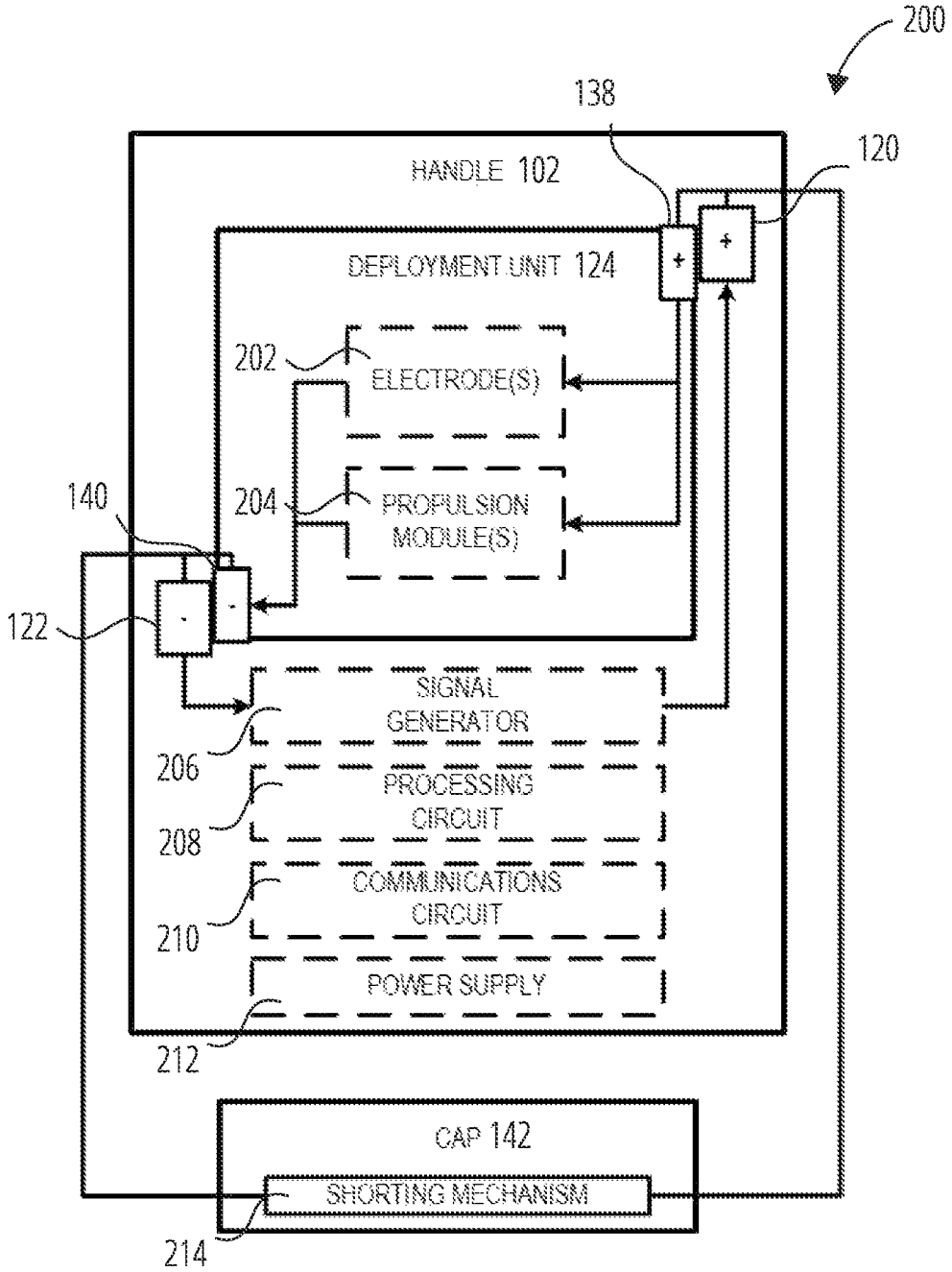
FIG. 2 is a schematic view of a CEW, in accordance with various embodiments.

In various embodiments, and with reference to FIG. 2, a CEW 200 is disclosed. CEW 200 may be similar to, or have similar aspects and/or components with, any CEW discussed herein. It should be understood by one skilled in the art that FIG. 2 is a schematic representation of CEW 200, and one or more of the components of CEW 200 may be located in any suitable position within, or external to, handle 102.

CEW 200 may comprise a handle 102, a deployment unit 124, and/or a cap 144. Each of handle 102, deployment unit 124, and/or cap 144 may be similar to, or the same as, the respective components discussed with reference to FIGS. 1A-1D.

In various embodiments, handle 102 may comprise a power supply 212, a communications circuit 210, a processing circuit 208, and/or a signal generator 206. Power supply 212 may be similar to any other power supply, battery, or the like disclosed herein. Communications circuit 210 may be similar to any other communications circuit or the like disclosed herein. Processing circuit 208 may be similar to any other processing circuit, processor, or the like disclosed herein. Signal generator 206 may be similar to any other signal generator or the like disclosed herein.

In various embodiments, power supply 212 may be configured to provide power to various components of CEW 200. For example, power supply 212 may provide energy for operating the electronic and/or electrical components (e.g., parts, subsystems, circuits, etc.) of CEW 200 and/or one or more deployment units 124. Power supply 212 may provide electrical power. Providing electrical power may include providing a current at a voltage. Power supply 212 may be electrically coupled to processing circuit 208, signal generator 206, and/or communications circuit 210. Power supply 212 may provide an electrical current at a voltage. Electrical power from power supply 212 may be provided as a direct current ("DC"). Electrical power from power supply 212 may be provided as an alternating current ("AC"). Power supply 212 may include a battery. The energy of power supply 212 may be renewable or exhaustible, and/or replaceable. For example, power supply 212 may comprise one or more rechargeable or disposable batteries. In various embodiments, the energy from power supply 212 may be converted from one form (e.g., electrical, magnetic, thermal) to another form to perform the functions of a system.

Power supply 212 may provide energy for performing the functions of CEW 200. For example, power supply 212 may provide the electrical current to signal generator 206 that is provided through a target to impede locomotion of the target (e.g., via deployment unit 124). Power supply 212 may provide the energy for a stimulus signal. Power supply 212 may provide the energy for other signals, including an ignition signal, as discussed further herein.

In various embodiments, processing circuit 208 may comprise any circuitry, electrical components, electronic components, software, and/or the like configured to perform various operations and functions discussed herein. For example, processing circuit 208 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 208 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 208 may include data buses, output ports, input ports, timers, memory, arithmetic units, and/or the like.

In various embodiments, processing circuit 208 may include signal conditioning circuitry. Signal conditioning circuitry may include level shifters to change (e.g., increase, decrease) the magnitude of a voltage (e.g., of a signal) before receipt by processing circuit 208 or to shift the magnitude of a voltage provided by processing circuit 208.

In various embodiments, processing circuit 208 may be configured to control and/or coordinate operation of some or all aspects of CEW 200. For example, processing circuit 208 may include (or be in communication with) memory configured to store data, programs, and/or instructions. The memory may comprise a tangible non-transitory computer-readable memory. Instructions stored on the tangible non-transitory memory may allow processing circuit 208 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 208 may be configured to provide and/or receive electrical signals whether digital and/or analog in form. Processing circuit 208 may provide and/or receive digital information via a data bus using any protocol. Processing circuit 208 may receive information, manipulate the received information, and provide the manipulated information. Processing circuit 208 may store information and retrieve stored information. Information received, stored, and/or manipulated by processing circuit 208 may be used to perform a function, control a function, and/or to perform an operation or execute a stored program.

Processing circuit 208 may control the operation and/or function of other circuits and/or components of CEW 200. Processing circuit 208 may receive status information regarding the operation of other components, perform calculations with respect to the status information, and provide commands (e.g., instructions) to one or more other components. Processing circuit 208 may command another component to start operation, continue operation, alter operation, suspend operation, cease operation, or the like. Commands and/or status may be communicated between processing circuit 208 and other circuits and/or components via any type of bus (e.g., SPI bus) including any type of data/address bus.

In various embodiments, processing circuit 208 may be mechanically and/or electronically coupled to trigger 112 (with brief reference to FIGS. 1A-1D). Processing circuit 208 may be configured to detect an activation, actuation, depression, input, etc. (collectively, an "activation event") of trigger 112. In response to detecting the activation event, processing circuit 208 may be configured to perform various operations and/or functions, as discussed further herein. Processing circuit 208 may also include a sensor (e.g., a trigger sensor) attached to trigger 112 and configured to detect an activation event of trigger 112. The sensor may comprise any suitable sensor, such as a mechanical and/or electronic sensor capable of detecting an activation event in trigger 112 and reporting the activation event to processing circuit 208.

In various embodiments, processing circuit 208 may be mechanically and/or electronically coupled to safety switch 114 (with brief reference to FIGS. 1A-1D). Processing circuit 208 may be configured to detect an activation, actuation, depression, input, etc. (collectively, a "control event") of safety switch 114. In response to detecting the control event, processing circuit 208 may be configured to perform various operations and/or functions, as discussed further herein. Processing circuit 208 may also include a sensor (e.g., a control sensor) attached to safety switch 114 and configured to detect a control event of safety switch 114. The sensor may comprise any suitable mechanical and/or electronic sensor capable of detecting a control event in safety switch 114 and reporting the control event to processing circuit 208.

In various embodiments, processing circuit 208 may be electrically and/or electronically coupled to power supply 212. Processing circuit 208 may receive power from power supply 212. The power received from power supply 212 may be used by processing circuit 208 to receive signals, process signals, and transmit signals to various other components in CEW 200. Processing circuit 208 may use power from power supply 212 to detect an activation event of a trigger, a control event of a safety switch, or the like, and generate one or more control signals in response to the detected events. The control signal may be based on the control event and the activation event. The control signal may be an electrical signal.

In various embodiments, processing circuit 208 may be electrically and/or electronically coupled to signal generator 206. Processing circuit 208 may be configured to transmit or provide control signals to signal generator 206 in response to detecting an activation event of a trigger. Multiple control signals may be provided from processing circuit 208 to signal generator 206 in series. In response to receiving the control signal, signal generator 206 may be configured to perform various functions and/or operations, as discussed further herein.

In various embodiments, signal generator 206 may be configured to receive one or more control signals from processing circuit 208. Signal generator 206 may provide an ignition signal to deployment unit 124 based on the control signals. Signal generator 206 may be electrically and/or electronically coupled to processing circuit 208 and/or deployment unit 124. Signal generator 206 may be electrically coupled to power supply 212. Signal generator 206 may use power received from power supply 212 to generate an ignition signal. For example, signal generator 206 may receive an electrical signal from power supply 212 that has first current and voltage values. Signal generator 206 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 206 may temporarily store power from power supply 212 and rely on the stored power entirely or in part to provide the ignition signal. Signal generator 206 may also rely on received power from power supply 212 entirely or in part to provide the ignition signal, without needing to temporarily store power.

Signal generator 206 may be controlled entirely or in part by processing circuit 208. In various embodiments, signal generator 206 and processing circuit 208 may be separate components (e.g., physically distinct and/or logically discrete). Signal generator 206 and processing circuit 208 may be a single component. For example, a control circuit within handle 102 may at least include signal generator 206 and processing circuit 208. The control circuit may also include other components and/or arrangements, including those that further integrate corresponding function of these elements into a single component or circuit, as well as those that further separate certain functions into separate components or circuits.

Signal generator 206 may be controlled by the control signals to generate an ignition signal having a predetermined current value or values. For example, signal generator 206 may include a current source. The control signal may be received by signal generator 206 to activate the current source at a current value of the current source. An additional control signal may be received to decrease a current of the current source. For example, signal generator 206 may include a pulse width modification circuit coupled between a current source and an output of the control circuit. A second control signal may be received by signal generator 206 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 206 may alternatively or additionally be employed, including those that apply a voltage over one or more different resistances to generate signals with different currents. In various embodiments, signal generator 206 may include a high-voltage module configured to deliver an electrical current having a high voltage. In various embodiments, signal generator 206 may include a low-voltage module configured to deliver an electrical current having a lower voltage, such as, for example, 2,000 volts.

Responsive to receipt of a signal indicating activation of a trigger (e.g., an activation event), a control circuit provides an ignition signal to deployment unit 124 (or an electrodes 202 in deployment unit 124). For example, signal generator 206 may provide an electrical signal as an ignition signal to deployment unit 124 in response to receiving a control signal from processing circuit 208. In various embodiments, the ignition signal may be separate and distinct from a stimulus signal. For example, a stimulus signal in CEW 200 may be provided to a different circuit within deployment unit 124, relative to a circuit to which an ignition signal is provided. Signal generator 206 may be configured to generate a stimulus signal. In various embodiments, a second, separate signal generator, component, or circuit (not shown) within handle 102 may be configured to generate the stimulus signal. Signal generator 206 may also provide a ground signal path for deployment unit 124, thereby completing a circuit for an electrical signal provided to deployment unit 124 by signal generator 206. The ground signal path may also be provided to deployment unit 124 by other elements in handle 102, including power supply 212.

In various embodiments, communications circuit 210 may be configured to enable communications between CEW 200 and one or more electronic devices, servers, computing devices, systems, and/or the like. Communications circuit 210 may be similar to, or comprise similar components with, any other communication unit, short-range communication unit, long-range communication unit, or the like disclosed here. Communications circuit 210 may be configured to communicate via any wired protocol, wireless protocol, or other protocol capable of transmitting information via a wired or wireless connection. In various embodiments, communications circuit 210 may be configured to enable short-range communications between devices. In various embodiments, communications circuit 210 may be configured to enable long-range communications between devices or systems. In various embodiments, communications circuit 210 may be configured to enable both short-range communications and long-range communications.

Communications circuit 210 may be configured to perform operations in response to receiving instructions from processing circuit 208. For example, responsive to cap 142 being ejected, processing circuit 208 enables communications circuit 210 and transmits a notification (e.g., message, data, signal, etc.) that cap 142 has been ejected and/or that safety switch 114 has been deactivate. The notification may be transmitted to an electronic device, such as a smart phone, a body-worn camera, and/or the like. The notification may be transmitted to one or more other entities of a system, e.g., law enforcement agency. As a further example, response to deployment unit 124 being deployed, processing circuit 208 enables communications circuit 210 and transmits a notification (e.g., message, data, signal, etc.) that a deployment of CEW 200 occurred.

In various embodiments, a bay of handle 102 may be configured to receive one or more deployment units 124. Deployment unit 124. Handle 102 may be configured to provide electrical signals to deployment unit 124. For example, signal generator 206 may be electrically coupled to first handle contact 120 and second handle contact 122. In response to deployment unit 124 being received in handle 102, first deployment unit contact 138 may electrically couple to first handle contact 120 and second deployment unit contact 140 may electrically couple to second handle contact 122.

In various embodiments, cap 142 (e.g., cover, CEW cap, handle cover, etc.) may comprise a shorting mechanism 214.

Shorting mechanism 214 may comprise a wire, a metal bar, a conductive pad, and/or any other conductive material. In response to cap 142 being coupled to handle 102, shorting mechanism 214 may be electrically coupled to at least one of first handle contact 120 or first deployment unit contact 138 and at least one of second handle contact 122 or second deployment unit contact 140.

In some embodiments, cap 142 may be configured to be ejected from responsive to a first signal. In some embodiments, the first signal comprises a safety switch of CEW 200 being activated. In other embodiments, the first signal comprises a trigger of CEW 200 being activated. In other embodiments, the first signal comprises CEW 200 receiving one or more commands from a user, e.g., via voice command, manual input, etc. In other embodiments, the first signal comprises other actions by users of CEW 200, sensor data processed by one or more components of CEW 200, signals or communications received by CEW 200 from one or more remote entities of a system, one or more environmental stimuli, or the like. Additionally, in some embodiments, the first signal may comprise a set of signals, e.g., a safety switch being activated in conjunction with one or more other actions.

In some embodiments, responsive to the first signal, cap 142 may be ejected via mechanical means, such as with an ejection spring. In other embodiments, responsive to the first signal, cap 142 may be ejected via another mechanical mechanism, e.g., an unlocking mechanism, lever, or other mechanical release. In other embodiments, responsive to the first signal, cap 142 may be ejected via an electrical impulse, e.g., via the electrodes or a secondary projectile interfacing with cover. In other embodiments, cap 142 may be ejected via any other means capable of removing cap 142 to enable deployment of electrodes 202 from deployment unit 124.

Cap 142 being ejected may enable electrodes disposed within deployment unit 124 to be deployed responsive to a second signal, e.g., activation of a trigger of CEW 200. In some embodiments, responsive to the second signal, CEW 200 transmits a second notification via communications circuit 210. For example, responsive to activation of a trigger of CEW 200, processing circuit 208 enables communications circuit 210 and transmits a notification that the trigger is activated to deploy electrodes 202 of deployment unit 124.

In various embodiments, shorting mechanism 214 may be configured to prevent (or at least partially reduce the likelihood of) an accidental or preemptive discharge of deployment unit 124. Accidental or preemptive discharge may occur due to a number of factors, such as users unintentionally pressing a trigger of CEW 200, static discharge accumulating within proximate to or within handle 102 or deployment unit 124, and the like. Shorting mechanism may provide an alternate electrical signal path for an unintended or accidental signal, bypassing one or more other signal paths through deployment unit 124. Preventing, or at least partially reducing the likelihood of, accidental or preemptive discharge may reserve deployment units for use when needed and reduce likelihood of stimulus signal being delivered to an incorrect target.

Figure 3:
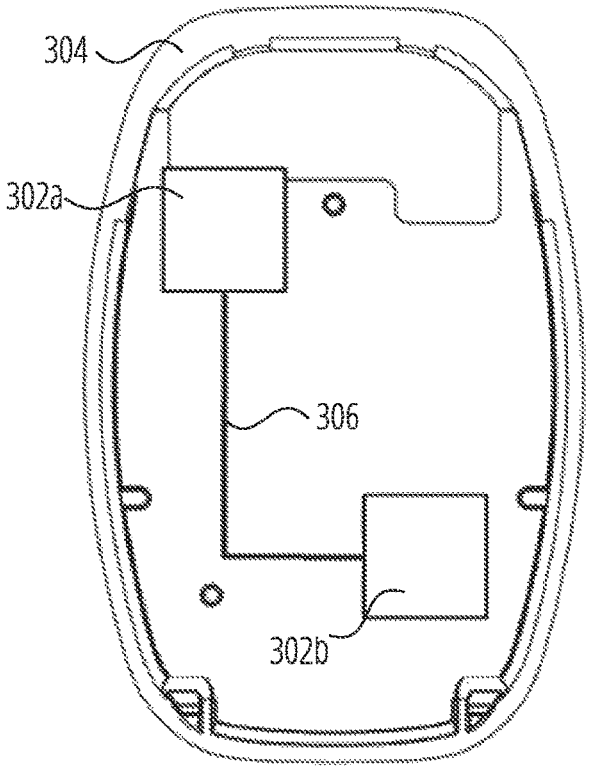
FIG. 3 is a rear view of a cap for a CEW, in accordance with various embodiments.

FIG. 3 is a rear view of a cap 304 (e.g., cover, handle cover, etc.) for a CEW, in accordance with various embodiments. Cap 304 may be similar to any other cap disclosed herein. Cap 304 may comprise a body having an outer surface opposite an inner surface. Cap 304 may be configured to be disposed on a first end of a handle. In some embodiments, when cap 304 is disposed on the first end of the handle, the handle (and a deployment unit received in a bay of the handle) may be prevented from deploying electrodes and/or providing a stimulus signal through the electrodes.

Cap 304 may comprise a shorting mechanism coupled to the inner surface. In various embodiments, the shorting mechanism may comprise one or more conductive pads (e.g., conductive foam pads, etc.). For example, the shorting mechanism may comprise a single conductive pad sized and shaped to contact at least one of a first handle contact and/or a first deployment unit contact and at least one of a second handle contact and/or a second deployment unit contact, in response to cap 304 being coupled to a handle. In other embodiments, the shorting mechanism may comprise a plurality of conductive pads in electrical series. Each conductive pad of the plurality of conductive pads may be configured to electrically couple to a contact of a respective deployment unit or handle.

For example, in various embodiments cap 304 may comprise a shorting mechanism 306 comprising a first conductive pad 302*a* and a second conductive pad 302*b*. First conductive pad 302*a* may be configured to electrically couple to a first handle contact and/or a first deployment unit contact. Second conductive pad 302*b* may be configured to electrically couple to a second handle contact and/or a second deployment unit contact. First conductive pad 302*a* may be in electrical series with second conductive pad 302*b*. Remaining portions of cap 204, aside from conductive pads 302 may comprise an insulative material. The remaining portions of cap 204 may comprise a material having a higher electrical resistance than conductive pads 302.

The conductive pads 302*a*, 302*b* may be arranged on the inner surface of cap 304 to align with the respective contacts in response to cap 304 being coupled to a handle. For example, in some embodiments, conductive pads 302*a*, 302*b* may be disposed at respective diagonal corners of the inner surface of cap 304. In other embodiments, conductive pads 302*a*, 302*b* may be disposed at any other orientation and position on the inner surface of cap 304.

Figure 4:
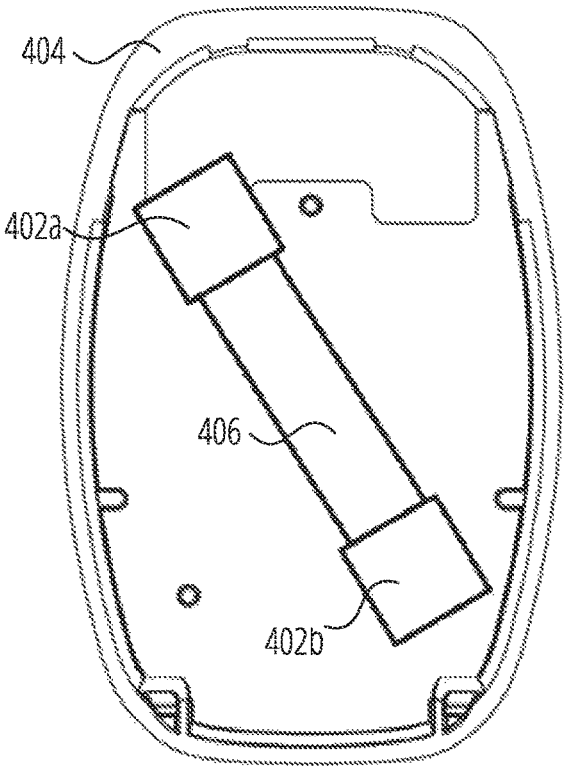
FIG. 4 is a rear view of a cap for a CEW, in accordance with various embodiments.

FIG. 4 is a rear view of a cap 404 (e.g., cover, handle cover, etc.) for a CEW, in accordance with various embodiments. Cap 404 may be similar to any other cap disclosed herein. Cap 404 may comprise a body having an outer surface opposite an inner surface. Cap 404 may be configured to be disposed on a first end of a handle. In some embodiments, when cap 404 is disposed on the first end of the handle, the handle (and a deployment unit received in a bay of the handle) may be prevented from deploying electrodes and/or providing a stimulus signal through the electrodes.

Cap 404 may comprise a shorting bar 406 (e.g., shorting mechanism) coupled to the inner surface.

Shorting bar 406 may comprise a conductive bar configured to interface between a first contact(s) (e.g., a first handle contact and/or a first deployment unit contact) and a second contact(s) (e.g., a second handle contact and/or a second deployment unit contact) of a respective handle and deployment unit. In some embodiments, shorting bar 406 comprises a conductive metal material, such that charge accumulated on one of the first contact(s) or the second contact(s) is distributed via shorting bar 406 to the other of the first contact(s) or the second contact(s). In other embodiments, shorting bar 406 comprises any other conductive material suitable for distributing charge between the first contact(s) or the second contact(s). By distributing charge, e.g., static discharge, between the first contact(s) or the second contact(s), shorting bar 406 ensures voltage is equal on the first contact(s) or the second contact(s), preventing discharge from causing accidental deployment of electrodes from the deployment unit.

In various embodiments, shorting bar 406 may comprise a body having a first contact 402*a* and a second contact 402*b*. Contacts 402*a*, 402*b* may comprise axial protrusions from respective ends of the body of shorting bar 406. First contact 402*a* may be configured to interface with a first handle contact of a handle and/or a first deployment unit contact of a deployment unit. Second contact 402*b* may be configured to interface with a second handle contact of a handle and/or a second deployment unit contact of a deployment unit.

The contacts 402*a*, 402*b* may be arranged on the inner surface of cap 404 to align with the respective handle contacts and/or deployment unit contacts in response to cap 404 being coupled to a handle. For example, in some embodiments, contacts 402*a*, 402*b* may be disposed at respective diagonal corners of the inner surface of cap 404. In other embodiments, contacts 402*a*, 402*b* may be disposed at any other orientation and position on the inner surface of cap 404.

Figure 5:
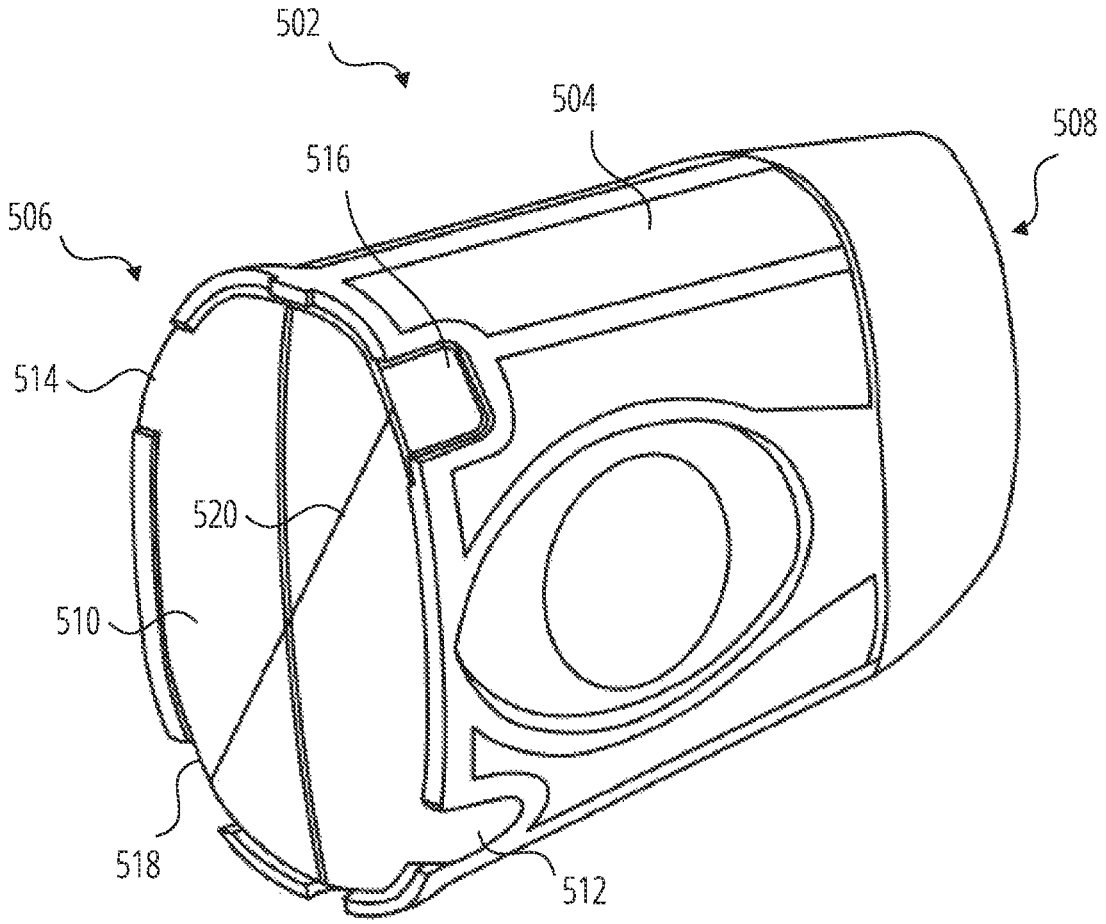
FIG. 5 is a perspective view of a deployment unit, in accordance with various embodiments.

FIG. 5 is a perspective view of a deployment unit 502, in accordance with various embodiments. Deployment unit 502 may be similar to any other deployment unit disclosed herein. Deployment unit 502 may comprise a deployment unit body 504 having a first deployment unit end 506 opposite a second deployment unit end 508. Deployment unit 502 may comprise blast doors 510 coupled to first deployment unit end 506. Blast doors 510 may be configured to obstruct (e.g., cover) the opening and electrodes of deployment unit 502 prior to deployment of the electrodes. Blast doors 510 may be coupled to first deployment unit end 506 at a first coupling point 512 and a second coupling point 514. In response to a deployment of electrodes, blast doors 510 may be configured to open, break, decouple, and/or the like to enable the electrodes to deploy from deployment unit 502. For example, in some embodiments blast doors 510 may comprise a frangible portion configured to break responsive to a deployment.

Deployment unit 502 may comprise a first deployment unit contact 516 and a second deployment unit contact 518. First deployment unit contact 516 and second deployment unit contact 518 may be disposed on first deployment unit end 506. For example, first deployment unit contact 516 and second deployment unit contact 518 may be disposed proximate blast doors 510. First deployment unit contact 516 and second deployment unit contact 518 may be disposed at least partially on a forward surface of first deployment unit 502 and/or at least partially on a radially outer surface of deployment unit body 504. First deployment unit contact 516 and second deployment unit contact 518 may be oriented diagonally from each other, and/or at any other suitable disposition. First deployment unit contact 516 and second deployment unit contact 518 may be electrically coupled to a propulsion module, one or more electrodes, and/or one or more filaments of electrodes within deployment unit 502.

In various embodiments, deployment unit 502 may comprise a shorting mechanism configured to interface with first deployment unit contact 516 and second deployment unit contact 518 without requiring a cap. For example, deployment unit 502 may comprise a fine-gauge wire 520. Fine-gauge wire 520 may be disposed proximate blast doors 510. Fine-gauge wire 520 may be mechanically coupled to blast doors 510. For example, fine-gauge wire 520 may be overmolded on to or within blast doors 510. Fine-gauge wire 520 may be disposed across each door of blast doors 510. Fine-gauge wire 520 may be disposed across blast doors 510 between electrical contacts of deployment unit 502. Opposite ends of fine-gauge wire 520 may be mechanically coupled to electrical contacts of deployment unit 502. For example, a first end of fine-gauge wire 520 may contact first deployment unit contact 516 and a second end of fine-gauge wire 520 may contact second deployment unit contact 518. Fine-gauge wire 520 may be electrically coupled between electrical contacts of deployment unit 502. For example, fine-gauge wire 520 may provide a conductive electrical signal path between first deployment unit contact 516 and second deployment unit contact 518.

Fine-gauge wire 520 may be configured to electrically couple first deployment unit contact 516 and second deployment unit contact 518. In some embodiments, fine-gauge wire 520 is any conductive wire capable of distributing charge between first deployment unit contact 516 and second deployment unit contact 518. In some embodiments, fine-gauge wire 520 may be capable of being ejected or burned through responsive to an electrical signal (e.g., by being comprised of a material and/or thinness unable to withstand the electrical signal).

In various embodiments, fine-gauge wire 520 may be burned responsive to an electrical signal from a handle of a CEW. For example, fine-gauge wire 520, first deployment unit contact 516, and second deployment unit contact 518 may form a circuit with a first handle contact, a second handle contact, and a signal generator, processing circuit, or power supply of a CEW handle. In response to the handle providing an electrical signal to deployment unit 502, fine-gauge wire 520 may burn through to no longer couple to each of first deployment unit contact 516 and second deployment unit contact 518. In various embodiments, the electrical signal (e.g., a first electrical signal) may be different than the ignition signal (e.g., a second electrical signal). In various embodiments, the electrical signal may be the ignition signal. In that respect, fine-gauge wire 520 may burn through at a first time before the ignition signal causes deployment of the electrodes at a second time.

Figure 6:
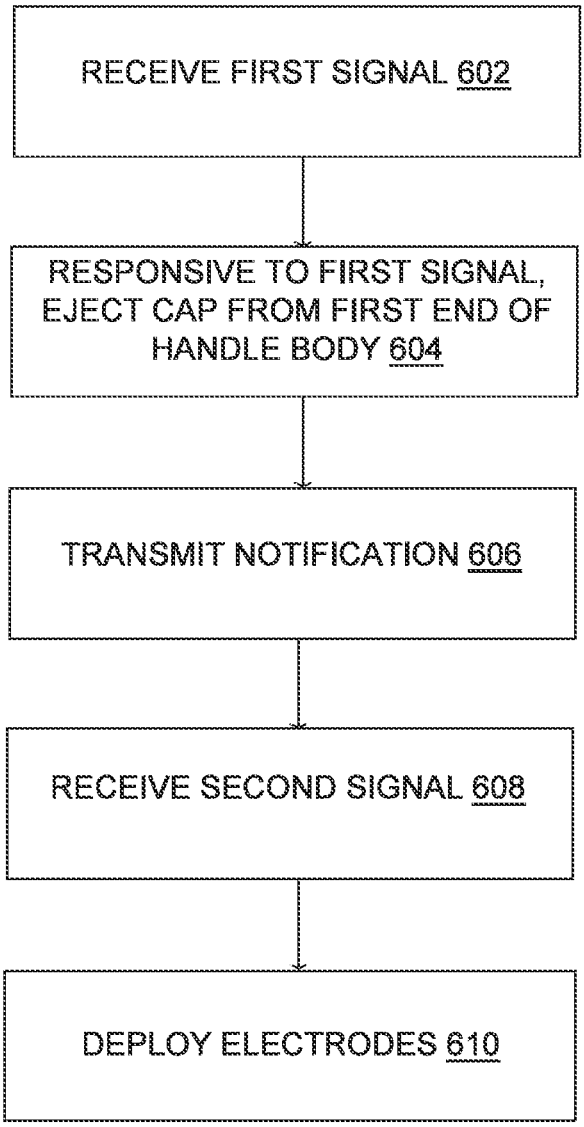
FIG. 6 is a process flow for a method of ejecting a cap from a handle of a CEW, in accordance with various embodiments.

FIG. 6 is a process flow for a method of ejecting a cap from a handle of a CEW, in accordance with various embodiments. For example, and in accordance with various embodiments, the method may include one or more steps for receiving a signal by a CEW and, responsive to the signal, ejecting a cap from a handle of the CEW. CEW may be similar to, or have similar aspects and/or components with, any CEW discussed herein. For example, CEW may comprise a handle, a deployment unit, and a cap. Handle may comprise or house one or more of a trigger and a safety switch, wherein the trigger and/or the safety switch may be coupled to a processing circuit of the handle of the CEW. Cap may comprise a shorting mechanism as discussed in conjunction with FIGS. 3 and 4.

The CEW receives 602 a first signal. In some embodiments, the first signal may be detected or received by the processing circuit of the CEW responsive to the safety switch being activated, e.g., translated from a rearward position to a forward position, depressed, or the like. In other embodiments, the first signal may be detected or received by the processing circuit of the CEW responsive to any other suitable signal, e.g., an ignition signal, or action, e.g., trigger activation by a user of the CEW.

Responsive to the first signal, the CEW ejects 604 cap from a first end of the handle. In some embodiments, CEW ejects cap via a handle mechanical coupling interface, e.g., a protrusion, latch, ejection spring, or other mechanical interface. For example, handle mechanical coupling interface may be activated by safety switch being translated from rearward position to forward position. In other embodiments, CEW ejects cap via an electrical or electromechanical coupling interface, e.g., via an electrical signal generated by handle of CEW.

In some embodiments wherein cap comprises a shorting mechanism (e.g., shorting bar), shorting mechanism may be ejected in conjunction with cap.

Responsive to cap being ejected, CEW transmits 606 a notification that cap has been ejected via one or more communications circuits. For example, in some embodiments, responsive to cap being ejected, CEW may transmit a notification that cap has been ejected and/or that safety switch has been deactivated. As previously discussed, the notification may be transmitted to an electronic device, such as a smart phone, a body-worn camera, and/or the like. The notification may be transmitted to one or more other entities of a system, e.g., law enforcement agency.

Responsive to cap being ejected, CEW may enable electrodes disposed within deployment unit to be deployed. The CEW receives 608 a second signal. In some embodiments, the second signal may be detected or received by the processing circuit of the CEW responsive to an action by a user of the CEW. In some embodiments, the second signal may be a same signal type as the first signal. In other embodiments, the second signal may be a different signal type than the first signal. For example, the second signal may comprise one or more of an ignition signal or a trigger activation by a user of the CEW.

Responsive to the second signal, the CEW deploys 610 electrodes of the deployment unit. In some embodiments, the CEW deploys at least one electrode the electrodes of the deployment unit. In some embodiments, the CEW deploys the at least one electrode by transmitting a signal to propulsion module of CEW to provide propulsion force to deploy the at least one electrode.

In the embodiments of FIG. 6, the method may be performed by a CEW, such as CEW 100. In other embodiments, the method may be performed in part or in whole by one or more other entities. Further, in other embodiments, the method may comprise additional or fewer steps, and the steps may be performed in a different order than described in conjunction with FIG. 6.

Figure 7:
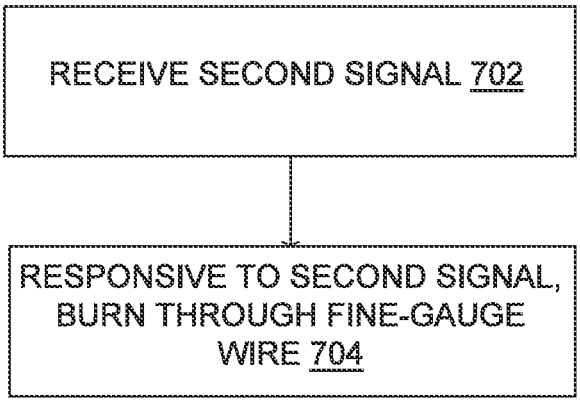
FIG. 7 is a process flow for a method of burning through fine-gauge wire, in accordance with various embodiments.

FIG. 7 is a process flow for a method of burning through fine-gauge wire, in accordance with various embodiments. For example, and in accordance with various embodiments, the method may include one or more steps for receiving a signal by a CEW and, responsive to the signal, burning through a fine-gauge wire of a deployment unit of the CEW to enable deployment of electrodes. CEW may be similar to, or have similar aspects and/or components with, any CEW discussed herein. For example, CEW may comprise a handle and a deployment unit. Handle may comprise or house one or more of a trigger and a safety switch, wherein the trigger and/or the safety switch may be coupled to a processing circuit of the handle of the CEW. Deployment unit may comprise a fine-gauge wire configured to contact a first deployment unit contact and a second deployment unit contact of the deployment unit.

In some embodiments, handle may additionally comprise a cap configured to couple to first handle end. The cap may be configured to be ejected from first handle end responsive to a first signal, as described in conjunction with FIG. 6.

The CEW receives 702 a second signal. In some embodiments, the second signal may be detected or received by the processing circuit of the CEW responsive to the safety switch being activated, e.g., translated from a rearward position to a forward position, depressed, or the like. In some examples wherein the handle additionally comprises a cap configured to be ejected responsive to a first signal, the first signal may be the same signal as the second signal. In other embodiments, the second signal may be detected or received by the processing circuit of the CEW responsive to an ignition signal. In other embodiments, the second signal may be detected or received by the processing circuit of the CEW responsive to any other suitable signal or action.

Responsive to the second signal, the CEW burns 704 through fine-gauge wire. For example, CEW provides an electrical signal to a circuit comprising fine-gauge wire, first deployment unit contact, and second deployment unit contact, and one or more components of CEW handle, e.g., one or more of: a first handle contact, a second handle contact, a signal generator, processing circuit, and/or power supply of CEW handle. The fine-gauge wire is comprised of a material and/or thinness unable to withstand the electrical signal, such that responsive to the CEW providing the electrical signal to the circuit, the fine-gauge wire burns through and enables deployment of electrodes of the deployment unit. In other examples, CEW may burn through, eject, or break fine-gauge wire by any other suitable mechanical, electrical, or electromechanical means.

In embodiments wherein second signal is an ignition signal, CEW may burn through fine-gauge wire by any suitable mechanical, electrical, or electromechanical means at a first time before the ignition signal causes deployment of the electrodes at a second time.

In some embodiments, responsive to fine-gauge wire being burned through, CEW transmits a notification that fine-gauge wire has been burned via one or more communications circuits. For example, CEW may transmit a notification that fine-gauge wire has been burned and/or, in embodiments wherein second signal is an ignition signal, that electrodes have been deployed. As previously discussed, the notification may be transmitted to an electronic device, such as a smart phone, a body-worn camera, and/or the like. The notification may be transmitted to one or more other entities of a system, e.g., law enforcement agency.

In the embodiments of FIG. 7, the method may be performed by a CEW, such as CEW 100. In other embodiments, the method may be performed in part or in whole by one or more other entities. Further, in other embodiments, the method may comprise additional or fewer steps, and the steps may be performed in a different order than described in conjunction with FIG. 7.

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Examples of various exemplary embodiments embodying aspects of the invention are presented in the following example set. It will be appreciated that all the examples contained in this disclosure are given by way of explanation, and not of limitation.

What is claimed is:

1. A conducted electrical weapon ("CEW") comprising:
- a deployment unit comprising one or more electrodes;
- a handle comprising a bay for receiving the deployment unit;
- a cap removably coupled to a first end of the handle, wherein the cap at least partially obstructs the bay and the deployment unit disposed within the bay;
- two or more deployment unit contacts disposed on a first end of the deployment unit; and
- a shorting mechanism configured to contact and distribute charge between the two or more deployment unit contacts.

2. The CEW of claim 1, wherein the handle is configured to perform steps comprising:
- receiving a first signal; and
- responsive to the first signal, ejecting the cap from the first end of the handle.

3. The CEW of claim 2, wherein the handle is further configured to perform steps comprising:
- receiving a second signal; and
- responsive to the second signal, deploying the deployment unit.

4. The CEW of claim 2, wherein the handle is further configured to perform steps comprising transmitting, responsive to the cap being ejected, a notification that the cap has been ejected.

5. The CEW of claim 1, wherein the deployment unit comprises one or more blast doors that obstruct the one or more electrodes of the deployment unit prior to deployment of the one or more electrodes.

6. The CEW of claim 1, wherein:
- the shorting mechanism comprises a fine-gauge wire integrated with the deployment unit between the two or more deployment unit contacts; and
- the handle is configured to perform steps comprising:
  - receiving a first signal; and
  - responsive to the first signal, burning through the fine-gauge wire.

7. The CEW of claim 6, wherein:
- the first signal comprises an ignition signal; and
- burning through the fine-gauge wire is performed at a first time before the ignition signal causes deployment of the deployment unit at a second time.

8. The CEW of claim 6, wherein burning through the fine-gauge wire comprises providing an electrical signal to a circuit comprising the fine-gauge wire.

9. The CEW of claim 8, wherein the circuit further comprises one or more of: deployment unit contacts of the deployment unit, handle contacts of the handle, a signal generator of the handle, a processing circuit of the handle, or a power supply of the handle.

10. The CEW of claim 1, wherein:
- the cap comprises the shorting mechanism; and
- the cap electrically couples the two or more deployment unit contacts via the shorting mechanism of the cap.

11. The CEW of claim 10, wherein the shorting mechanism comprises at least one of: a shorting bar or a plurality of conductive pads in electrical series.

12. A conducted electrical weapon ("CEW") comprising:
- a cap disposed on a first end of a handle, the cap comprising a shorting mechanism; and
- the handle comprising a bay for receiving a deployment unit with two or more deployment unit contacts electrically coupled by the shorting mechanism, wherein the handle is configured to perform steps comprising:
  - receiving a first signal; and
- responsive to the first signal, ejecting the cap from the first end of the handle.

13. The CEW of claim 12, wherein:
- the handle further comprises a safety switch coupled to an outer surface of the handle; and
- wherein the first signal is the safety switch being activated, the safety switch being activated comprising the safety switch being translated from a rearward position to a forward position.

14. The CEW of claim 13, wherein translation of the safety switch mechanically translates a handle mechanical coupling interface to cause the cap to be ejected from the first end of the handle.

15. The CEW of claim 14, wherein the handle mechanical coupling interface comprises one or more of: a latch, a protrusion, or an ejection spring.

16. The CEW of claim 12, wherein the cap comprises one or more handle contacts electrically coupled by the shorting mechanism of the cap and the one or more handle contacts connect the two or more deployment unit contacts.

17. A deployment unit comprising:

blast doors coupled to a first end of the deployment unit and configured to obstruct one or more electrodes of the deployment unit prior to deployment of the one or more electrodes;

one or more deployment unit contacts disposed on the first end of the deployment unit; and a fine-gauge wire configured to contact and distribute charge between the one or more deployment unit contacts.

18. The deployment unit of claim 17, wherein the two or more deployment unit contacts comprise a first deployment unit contact and a second deployment unit contact.

19. The deployment unit of claim 17, wherein the two or more deployment unit contacts are electrically coupled to a propulsion module, the one or more electrodes, or one or more filaments of electrodes of the deployment unit.

20. The deployment unit of claim 17, wherein the fine-gauge wire is comprised of one or more of: a material unable to withstand an electrical signal or a thinness unable to withstand the electrical signal.

* * * * *